US011060717B2

(12) United States Patent
English et al.

(10) Patent No.: US 11,060,717 B2
(45) Date of Patent: Jul. 13, 2021

(54) MULTIPLE PASS FLEXIBLE WATER TUBE BOILER AND METHOD OF USING SAME

(71) Applicant: English Boiler, LLC, Henrico, VA (US)

(72) Inventors: John R. English, Mechanicsville, VA (US); Sundeep Bodapati, Richmond, VA (US)

(73) Assignee: Superior Boiler, LLC, Richmond, VA (US)

( * ) Notice: Subject to any disclaimer, the term of this patent is extended or adjusted under 35 U.S.C. 154(b) by 210 days.

(21) Appl. No.: 16/035,633

(22) Filed: Jul. 14, 2018

(65) Prior Publication Data

US 2019/0017697 A1 Jan. 17, 2019

Related U.S. Application Data

(60) Provisional application No. 62/532,405, filed on Jul. 14, 2017.

(51) Int. Cl.

| | |
|---|---|
| ***F22B 21/10*** | (2006.01) |
| ***F22B 21/22*** | (2006.01) |
| ***F22B 37/10*** | (2006.01) |

(52) U.S. Cl.

CPC ..... *F22B 21/10* (2013.01); *F22B 21/22* (2013.01); *F22B 37/104* (2013.01)

(58) Field of Classification Search

CPC ..... F22B 21/10

See application file for complete search history.

(56) References Cited

U.S. PATENT DOCUMENTS

| | | | | |
|---|---|---|---|---|
| 3,835,920 A * | 9/1974 | Mondt | F28D 7/06 | 165/81 |
| 4,993,368 A * | 2/1991 | Jones | F22B 21/24 | 122/235.23 |
| 5,870,976 A * | 2/1999 | Cooke | F22B 1/18 | 122/235.15 |
| 6,817,319 B1 * | 11/2004 | Manay | F22B 21/366 | 122/235.11 |
| 7,137,360 B1 * | 11/2006 | Zorzit | F22B 13/04 | 122/235.11 |

FOREIGN PATENT DOCUMENTS

| | | | |
|---|---|---|---|
| CA | 2205452 A1 * | 11/1998 | F22B 21/04 |

* cited by examiner

*Primary Examiner* — Nathaniel Herzfeld

(74) *Attorney, Agent, or Firm* — IPCL Group PLC; Anthony Tacconi, Esq.

(57) ABSTRACT

A package multiple pass flexible water tube boiler having staggered tubes that are substantially identical in length. The staggered tube arrangement, along with the inclusion of a plurality of baffles, optimizes heat transfer and minimizes the footprint of the unit.

13 Claims, 3 Drawing Sheets

MULTIPLE PASS FLEXIBLE WATER TUBE BOILER AND METHOD OF USING SAME

This application claims priority from U.S. Provisional Patent Application No. 62/532,405 filed on Jul. 14, 2017.

FIELD OF THE INVENTION

The invention relates to package water tube boilers, and more specifically, smaller commercial flexible water tube boilers.

BACKGROUND OF THE INVENTION

Boilers are used in a variety of applications and processes in the world today. One of the more common types of boilers, the water-tube boiler, uses heat from fuel burned within a combustion chamber to heat water circulating through a network of internal tubes. Water-tube boilers typically consist of two principal sections, a radiant section and a convective section.

Package water-tube boilers are small to mid-sized water tube boilers that are preconstructed and assembled in a factory. These types of boilers can be shipped and installed as a complete unit, including an integrated burner, and do not require much more than fuel and water sources and appropriate ventilation.

A fundamental advantage of package boilers is an installed cost which is considerably lower than that of a field-erected boiler. This cost advantage is made possible by basic designs that allow standardized fabrication processes while still providing sufficient flexibility to permit satisfactory adaptation to the specific needs of a particular application. As a result, package boilers are typically constructed using standard, industry wide designs. Through a modification of the tube arrangement and/or the addition of baffles, a multi-pass boiler can also be created.

The configuration of the tubes connecting the lower drum to the upper drum is especially important in a package boiler. These tubes must not only convey water to the upper drum but must also adequately cool the unit and the walls in order for the boiler to have its small size. This is an important point as the space available within the unit for insulation is limited.

It would be advantageous to provide a package boiler with the highest operational efficiency while maintaining the smallest footprint. It is further desirable to accomplish such goals while reducing the overall manufacturing costs of the boiler unit.

DESCRIPTION OF THE DRAWINGS

FIG. 1(*b*) is a transverse view showing a second set of water tubes.

DETAILED DESCRIPTION

Figure 2:
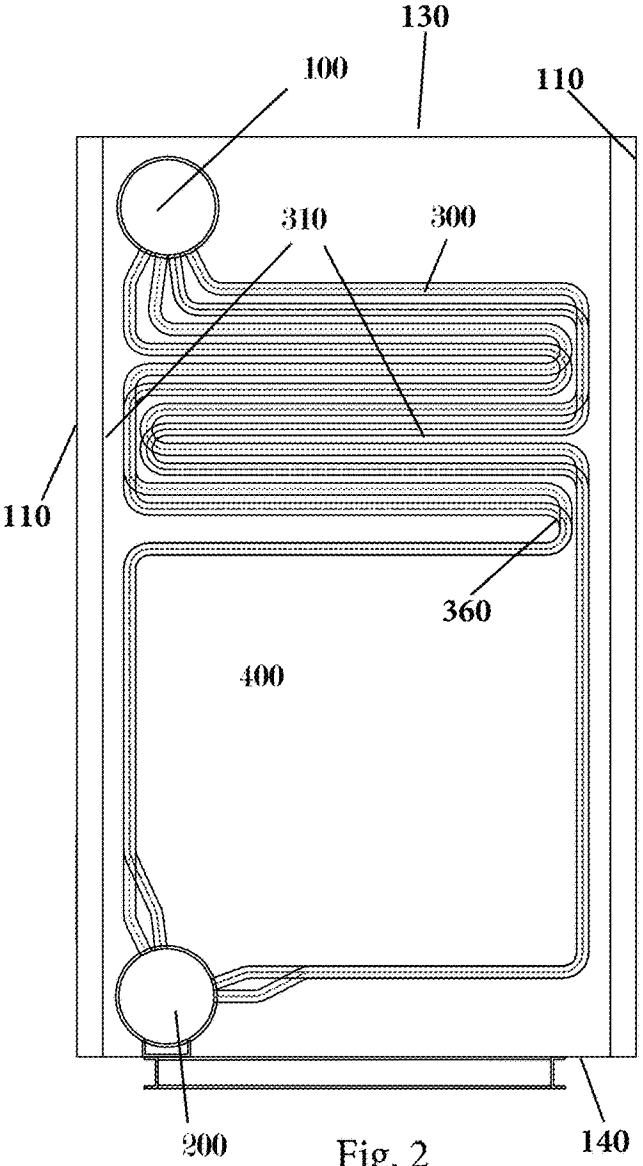
FIG. 2 is a transverse view of a water tube boiler unit having both the first and second set of water tubes installed.

The invention comprises a multiple pass flexible water tube boiler having a novel tube design which may be used in both hot water and steam applications. FIG. 2 is a transverse section of a water tube boiler unit having such a tube design. The boiler includes a housing having four walls which, inter alia, reduce thermal loss. Sidewalls 110 are connected to end walls (not shown), top surface 130, and bottom surface 140. As shown in FIG. 2, an upper drum or steam/water drum 100, a lower drum or mud drum 200, and a plurality of conduits 300, i.e., metal tubes of essentially equal length, are disposed within the housing. The upper and lower drums are aligned in this design. The drums 100 and 200 may be made of steel or any analogous material.

A plurality of metal water tubes 300 of essentially equal length connect the lower drum 200 to the upper drum 100. A combustion chamber 400 is defined by the lower portion of the tubes 300. The upper portion of the tubes reside in a convection section 310 of the boiler. A gas outlet (not shown) allows the exhaust gas to escape. One or more external downcomers (not shown) may be used to transport cooler water from the upper drum to the lower drum.

Figure 1B:
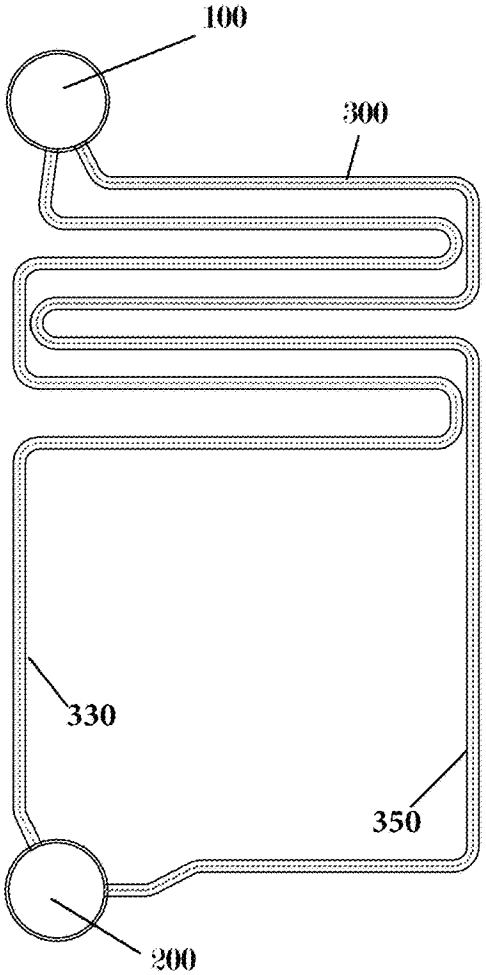
FIG. 1(*a*) is a transverse view showing a first set of water tubes.
Figure 1A:
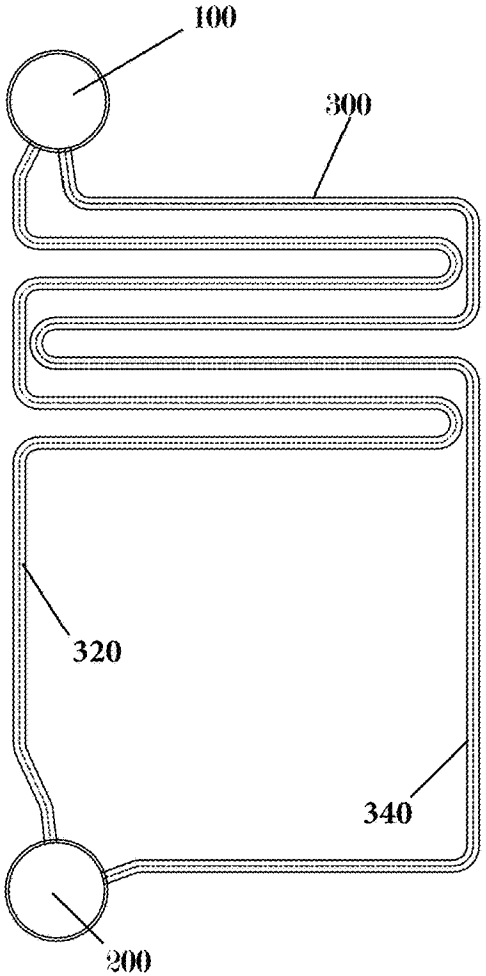
Figure 3:
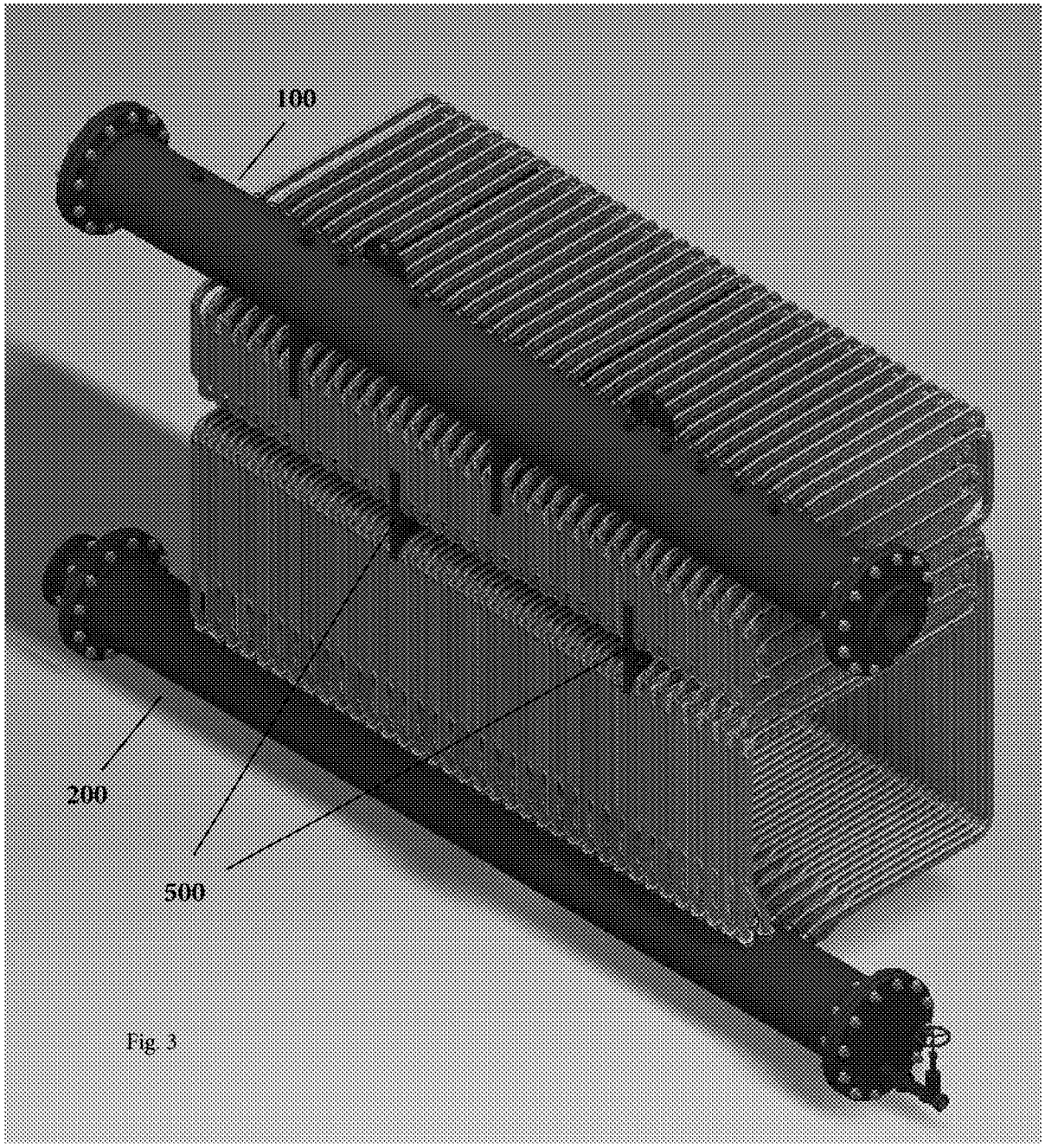
FIG. 3 is an isometric view of the drum and tube assembly.
Figure 4:
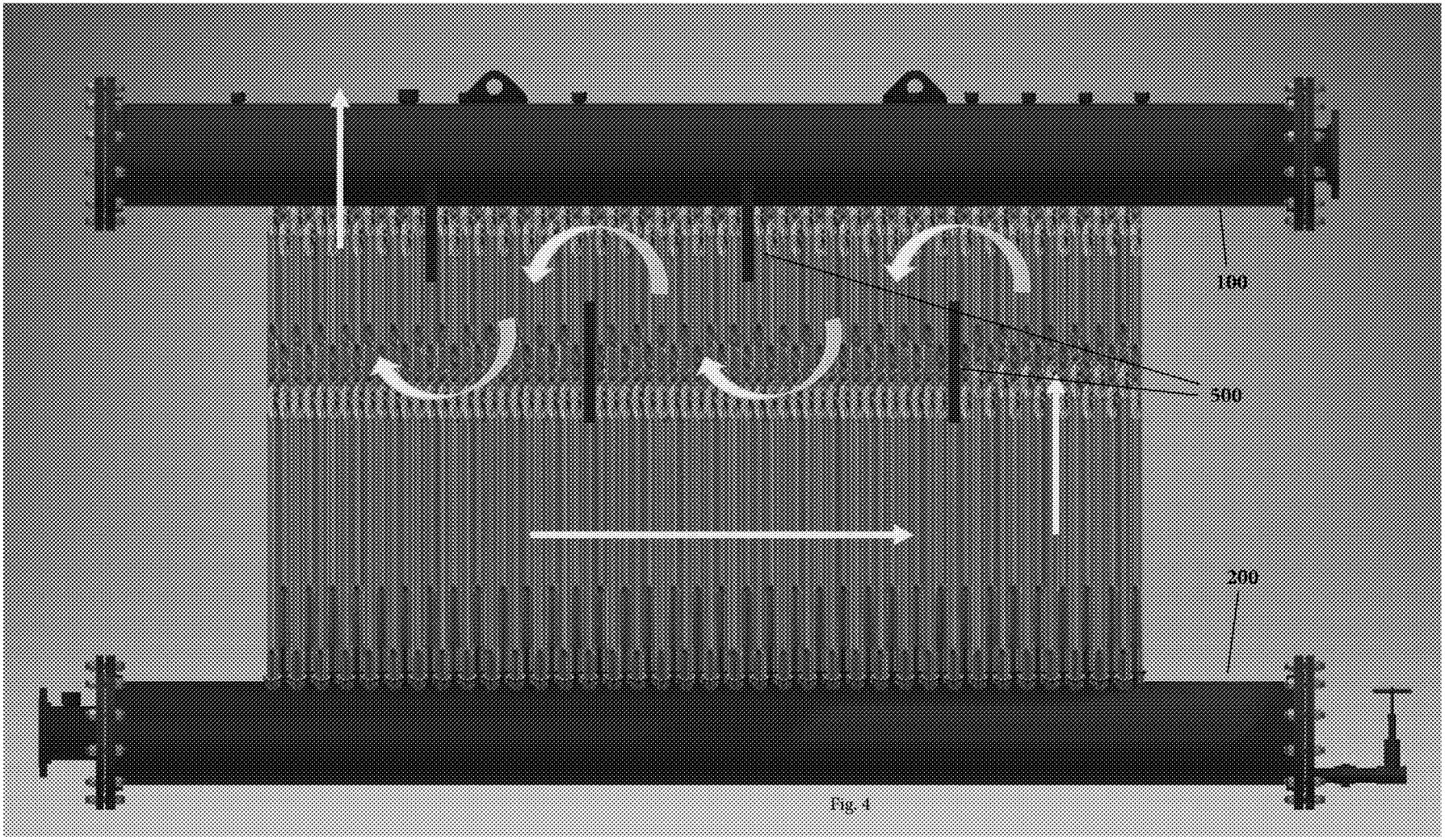
FIG. 4 is an isometric side view of the drum and tube assembly.

The invention incorporates a parallel series of staggered water tubes 300, arranged in two groups of repeating tubes, along the long axis of the drums 100, 200. Referring to FIG. 1(*a*-*b*), the conduits 300 are comprised of a first set of water tubes Group A, shown in FIG. 1(*a*), and a second set of water tubes Group B, shown in FIG. 1(*b*) which are positioned in a generally staggered or interlocking arrangement when installed in the boiler unit, as shown in FIGS. 2-4.

The first tube grouping consists of tubes 320 and 340 and the second grouping consists of tubes 330 and 350. This sequence of tubes, i.e., tubes 320, 340 and then tubes 330, 350, can then be repeated within the enclosure until the desired number of water tubes is attained. One of the preferred embodiments of the boiler would have a total of seventy-four tubes, i.e. thirty seven tubes per set, but it will be recognized that the aggregate number of tubes within the unit could be adjusted as desired.

As seen in FIG. 1, tube 320 of Group A and tube 330 of Group B are essentially the same shape and, tube 340 of Group A and tube 350 of Group B are of essentially the same shape. It will be noted that the shape of the tubes in each group varies at (i) the junction(s) with the upper and lower drums and (ii) the first bend 360 entering the convection zone. At the first bend 360, tube 330 bends at a wider angle than tube 320, i.e., the tube of set one is offset in an upward direction, which permits the two sets of tubes to be staggered for most of their passage from the lower drum 200 to the upper drum 100 within the convection zone 310. The tubes 300 are composed of carbon steel or analogous material.

It will also be noted that although Group A and Group B have substantially the same design, due to the difference in the first bend in these two tube groups, their horizontal runs will not be situated parallel, i.e., within the same horizontal plane, within the boiler. This allows for a staggering of the water tubes which is a design not found in a conventional boiler. In a conventional boiler, all, or substantially all, of the riser tubes are of identical design and mounted in an identical position, yielding a generally uniform arrangement of parallel tubes from the front to the back of the boiler.

In the instant arrangement, illustrated in FIGS. 1-4, the tight interlocking nature of the tubes prevents gases from traveling between the radiant and convection sections of the boiler and further increases the efficiency of the unit. The boiler can, however, also be operated as a multiple pass boiler via the installation of baffles within the convection section. Specifically, one or more baffles 500 are installed to control the flow of gases so that the gases can be directed to make multiple passes over the tubes prior to discharge from the enclosure. Insulation may be present within the housing, where required, to further prevent gas leakage or thermal loss.

In addition, a limited number of tubes, e.g., ten to twelve tubes, are bent slightly differently than the main body of riser tubes 300 in order to allow flue gas from the combustion chamber 400 to enter the convection section 310. These tubes are typically located near the far or back end of the furnace.

In operation, a burner injects air and atomized fuel into the combustion chamber 400 creating a flame which extends through the combustion chamber 400 towards the rear wall. The combustion gases then pass through the convection section of the water tubes and, ultimately, exit via a gas outlet. The heat absorbed by the water tubes 300 heats the water in the tubes which is transported to the upper steam/water drum 100. Depending on the application, tubes 340 and 350 may also act as downcomer tubes, permitting return of water to the lower drum 200. During operation, the flue gas does not, however, simply travel in a horizontal direction within the convection bank as it would in a conventional boiler. Rather the gas flows through one or more cycles of upward and downward motion along the length of the convection section until exiting at the gas outlet. FIG. 4 shows the general direction and flow path of flue gas through the unit while in operation.

As noted above, all of the tubes 300 are of essentially equal length within a manufacturing tolerance of one to three percent difference. Use of such equal length tubes is critical in hot water applications as it enables the water flow in the tubes to be balanced. This balance improves the heat transfer rate in the tubes, which, inter alia, increases the life of the tube material.

If the tubes are not of equal length(s), the standard practice is to use an orifice to help balance the water flow in the tubes. Adding an orifice requires an extra manufacturing step resulting in increased material and labor costs. No orifice is required in the instant arrangement since all the tubes have similar lengths.

The staggered tube arrangement substantially improves heat transfer within the boiler. Further, the combination of the staggered tube arrangement and the use baffles, as shown in FIGS. 3 and 4, maximizes heat transfer and further reduces the footprint of the apparatus. Since the total heat transfer surface necessary is less than would be required with a conventional water tube arrangement, a boiler having the instant configuration and a smaller footprint would be able to maintain the same operational parameters as a boiler having a conventional tube arrangement and, by extension, a larger footprint.

A boiler unit designed in this fashion has a quick response time and can generally be brought online in minutes. Because the unit uses only four tubes per section, the unit can be made to operate at a higher capacity and higher pressure than a conventional unit having ten or more such tubes.

Overall manufacturing costs are reduced when employing this design, as the designs of tube set A and tube set B are essentially identical, except for the differences noted above. Costs are therefore reduced because other than those minimal differences, the same tubes are being manufactured and installed.

While the invention has been described in reference to certain preferred embodiments, it will be readily apparent to one of ordinary skill in the art that certain modifications or variations may be made to the system without departing from the scope of invention claimed below and described in the foregoing specification.

What is claimed is:

1. A multiple-pass flexible water tube boiler comprising:

an enclosure formed by a first side wall, a second side wall, a front wall, a rear wall, a top surface and a bottom surface;

a cylindrical upper drum having its longitudinal axis proximate to either said first side wall or said second side wall;

a cylindrical lower drum located at a position substantially vertically aligned with said upper drum;

boiler tubes of essentially equal length connecting, and allowing communication between, said lower drum and said upper drum wherein said tubes comprise:

(i) a first group of two water tubes being in the same plane and having a first tube exiting said lower drum extending laterally in an essentially horizontal run, crossing the centerline of the boiler, toward said second wall then upward in a vertical run then turning to execute one or more additional horizontal runs by extending horizontally along a longitudinal center line toward a side wall, crossing the centerline of the boiler, and then turning and running horizontally again and repeating until said first tube terminates at an entrance in said upper drum, and a second tube exiting said lower drum and extending upward in a vertical run along said first side wall, then turning to execute one or more additional horizontal runs by extending horizontally along a longitudinal center line toward a side wall, crossing the centerline of the boiler, and then turning and running horizontally again and repeating until said second tube terminates at an entrance to said upper drum; said first tube and said second tube not being of identical shape; and, (ii) a second group of two water tubes being in the same plane and having a third tube exiting said lower drum, extending laterally in an essentially horizontal run, crossing the centerline of the boiler, toward said second wall then upward in a vertical run then turning to execute one or more additional horizontal runs by extending horizontally along a longitudinal center line toward a side wall, crossing the centerline of the boiler, and then turning and running horizontally again and repeating until said third tube terminates at an entrance in the upper drum, and a fourth tube exiting said lower drum and extending upward in a vertical run along said first side wall, then turning to execute one or more additional horizontal runs by extending horizontally along a longitudinal center line toward a side wall, crossing the centerline of the boiler, and then turning and running horizontally again and repeating until said fourth tube terminates at an entrance to said upper drum, said third tube and said fourth tube not being of identical shape;

wherein said longitudinal center lines of said fourth tube during horizontal runs are essentially parallel to said longitudinal center lines of said second tube during horizontal runs but are offset in an upward direction;

a combustion chamber defined by a portion of said boiler tubes; and, a convection section defined by a portion of said boiler tubes.

2. The water tube boiler of claim 1 further comprising a plurality of offset boiler tubes wherein said tubes comprise repeating sections of said first group and said second group of water tubes arranged within said enclosure.

3. The water tube boiler of claim 1 further comprising a burner in communication with said combustion chamber.

4. The water tube boiler of claim 1 wherein said turning to execute one or more horizontal runs of said first, second, third, and fourth tubes is achieved by the completion of no greater than six 180 degree turns.

5. The water tube boiler of claim 1 further comprising said first tube having no more than one 180 degree bend.

6. The water tube boiler of claim 1 further comprising said second tube having no more than two 180 degree bends.

7. The water tube boiler of claim 1 further comprising said third tube having no more than one 180 degree bend.

8. The water tube boiler of claim 4 wherein all of said 180 degree turns are completed at a location proximal to said first or second sidewall.

9. The water tube boiler of claim 1 wherein said convection section defines a single continuous gas flow path for flue gas traversing said section.

10. The water tube boiler of claim 9 further comprising at least two baffles positioned within said convection section which further define a flue gas path through said section; said flue gas path being in a substantially vertical direction at locations proximate to said baffles.

11. The water tube boiler of claim 1 wherein said additional horizontal runs of said first group of water tubes and said additional horizontal runs of said second group of water tubes are essentially parallel.

12. The water tube boiler of claim 1 wherein said additional horizontal runs of said first water tube and said additional horizontal runs of said second water tube are essentially parallel.

13. The water tube boiler of claim 1 wherein said additional horizontal runs of said third water tube and said additional horizontal runs of said fourth water tube are essentially parallel.

* * * * *